US007490465B2

(12) United States Patent
Weimert et al.

(10) Patent No.: US 7,490,465 B2
(45) Date of Patent: Feb. 17, 2009

(54) EXHAUST SYSTEM FOR A DRIVE UNIT FORMED BY A TRANSMISSION AND AN ENGINE

(75) Inventors: Guenter Weimert, Bad Wildbad (DE); Harald Mann, Ludwigsburg (DE); Markus Menzel, Jockgrim (DE)

(73) Assignee: Dr. Ing. h.c. F. Porsche AG, Weissach (DE)

( * ) Notice: Subject to any disclaimer, the term of this patent is extended or adjusted under 35 U.S.C. 154(b) by 85 days.

(21) Appl. No.: 11/578,955

(22) PCT Filed: Mar. 15, 2005

(86) PCT No.: PCT/EP2005/002726

§ 371 (c)(1),
(2), (4) Date: Oct. 19, 2006

(87) PCT Pub. No.: WO2005/113956

PCT Pub. Date: Dec. 1, 2005

(65) Prior Publication Data

US 2007/0220872 A1 Sep. 27, 2007

(30) Foreign Application Priority Data

May 7, 2004 (DE) ..... 10 2004 022 720

(51) Int. Cl.
*F01N 3/10* (2006.01)

(52) U.S. Cl. ..... 60/299; 60/322; 60/323; 60/324; 180/89.2; 180/296; 180/309

(58) Field of Classification Search ..... 60/272, 60/299, 322, 323, 324; 180/89.2, 296, 309
See application file for complete search history.

(56) References Cited

U.S. PATENT DOCUMENTS

| | | | | |
|---|---|---|---|---|
| 3,942,599 | A * | 3/1976 | Shimada | 180/292 |
| 4,339,919 | A | 7/1982 | Jobling et al. | |
| 4,559,776 | A | 12/1985 | Arai et al. | |
| 4,884,399 | A * | 12/1989 | Morris | 60/313 |
| 5,433,075 | A * | 7/1995 | Nakamura et al. | 60/322 |
| 5,880,413 | A | 3/1999 | Wagner et al. | |
| 5,921,080 | A * | 7/1999 | Ulmet et al. | 60/308 |
| 6,106,344 | A | 8/2000 | Mashiko | |
| 6,141,958 | A * | 11/2000 | Voss | 60/272 |
| 6,412,587 | B1 * | 7/2002 | Weimert et al. | 180/309 |

FOREIGN PATENT DOCUMENTS

| | | |
|---|---|---|
| DE | 40 32 431 C1 | 4/1992 |
| DE | 198 15 705 A1 | 10/1999 |

OTHER PUBLICATIONS

International Search Report Dated Jun. 24, 2005 with English translation of relevant portion (Eleven (11) Pages).

* cited by examiner

*Primary Examiner*—Binh Q. Tran

(57) ABSTRACT

An exhaust system for a drive unit formed by the transmission and the engine, having exhaust-gas-carrying pipes and at least one muffler and catalyst housing. A holding part can be fastened to the transmission and/or the engine and on whose supporting leg the exhaust system can be fastened or suspended. A fastening clamp for accommodating a catalyst housing is provided on the end of the respective supporting leg.

8 Claims, 4 Drawing Sheets

EXHAUST SYSTEM FOR A DRIVE UNIT FORMED BY A TRANSMISSION AND AN ENGINE

RELATED APPLICATIONS

This application is a National Phase Entry under 35 U.S.C. § 371 of International Patent Application No. PCT/EP2005/002726, filed Mar. 15, 2005, which is based on and claims priority to German Patent Application No. DE 10 2004 022 720.9, filed May 7, 2004, the contents of each of which are incorporated by reference herein in their entirety.

BACKGROUND AND SUMMARY OF THE INVENTION

The present invention relates to an exhaust system for a drive unit formed by the transmission and the engine, and more particularly to an exhaust system having exhaust-gas-carrying pipes and at least one muffler and catalyst housing as well as having a holding part which can be fastened to the transmission and/or the engine and on whose supporting led the exhaust system can be fastened or suspended.

DE 40 32 431 C1 describes a suspension device for a double-flow exhaust system of a motor vehicle, in which the suspension device has a central holding part on which, in an elastically disposed manner, supporting legs are fastened which lead to the exhaust pipes of the exhaust system.

DE 198 15 705 A1 describes a fastening device for an exhaust pipe on a vehicle component in which a console of the fastening device has a shell element in the shape of a cylinder segment which can be fastened on an essentially linear section of an exhaust pipe by holding devices reaching around the exhaust pipe.

An object of the present invention is to provide an improved suspension device which is durable and stable despite the assembly vibrations occurring in the motor vehicle.

The foregoing object has been achieved by providing a fastening clamp for accommodating a catalyst housing on an end of the respective supporting leg.

The fastening device for the exhaust system according to the invention consists of a holding part with supporting legs which are fastened by a clamp construction to the catalyst housing of the exhaust system. As a result of the fact that the catalyst housing has a significantly larger diameter than the exhaust pipes, by this type of fastening achieves a stable and durable suspension of the entire exhaust system.

Another stabilizing measure which is used for the suspension of the entire exhaust system comprises at least a portion of the catalyst housing being integrated in an end muffler of the exhaust system.

The supporting legs to which the exhaust system is fastened are advantageously constructed as a lower continuous strut which is supported by two upper struts, each connecting the holding part and the clamps. The two upper struts are each connected with a damping element which are coordinated such that the occurring assembly or exhaust system vibrations can be effectively reduced.

For linking the fastening clamp to the lower strut and the two upper struts, one holder respectively is provided to which the lower strut and the two upper struts are correspondingly by a clamping or by a screwed connection. The holding part screwed on the face side to the transmission of the drive unit is constructed as a casting or stamping in the form of a one-piece carrier plate.

BRIEF DESCRIPTION OF THE DRAWINGS

An embodiment of the present invention is described in greater detail on the basis of the drawings, in which.

DETAILED DESCRIPTION OF THE DRAWINGS

Figure 1:
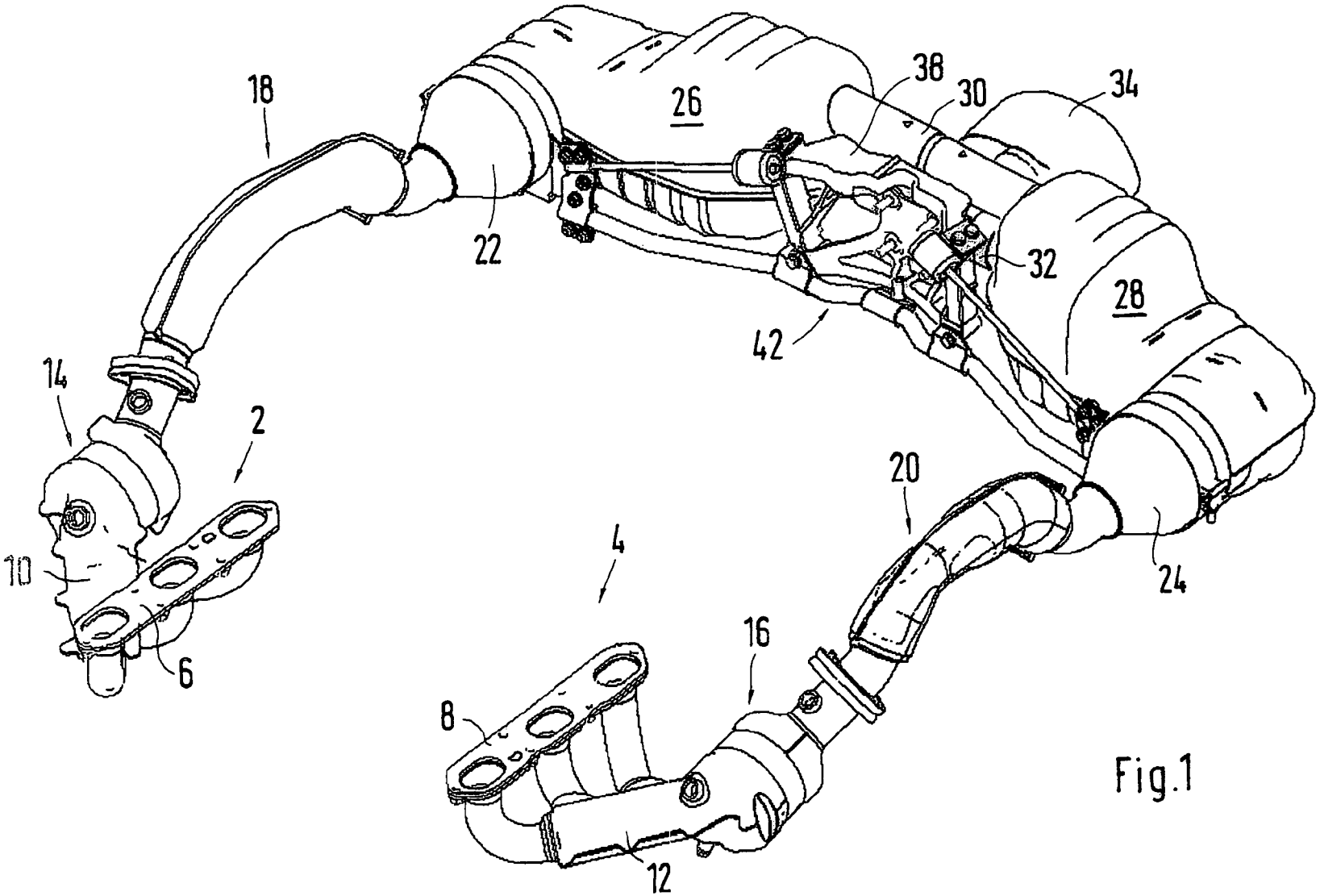
FIG. 1 is a perspective view of an exhaust system having a fastening device, in accordance with the present invention.
Figure 2:
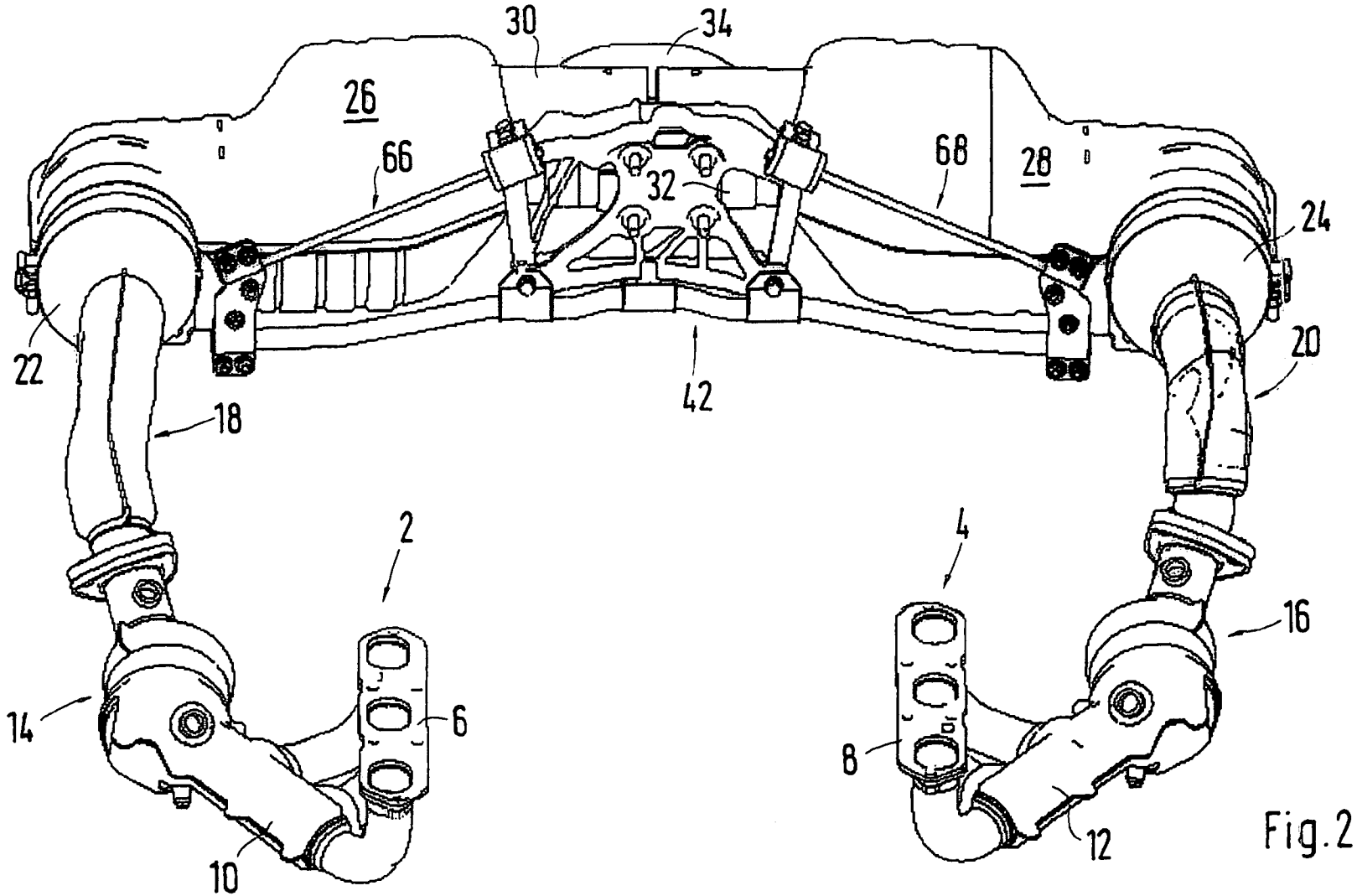
FIG. 2 is a second perspective view of the exhaust system shown in FIG. 1.

The double-flow exhaust system for a 6-cylinder engine has one exhaust elbow 2, 4 respectively which is in each case fastened by its respective flange section 6,8 on the cylinder head of an engine unit (not shown). The three individual pipes of the exhaust elbow 2,4 lead into an exhaust gas collecting pipe 10,12, respectively which is adjoined by a respective housing 14,16 of a starting catalyst. One exhaust pipe 18,20 respectively is flanged to the two starting catalysts 14, 16, and each of the exhaust pipes 18, 20 leads to a respective housing 22,24 in which a main catalyst is accommodated. The two main catalysts 22, 24 are each accommodated in an end muffler housing 26,28 respectively or are partially integrated therein. Both end muffler housings 26,28 are fluidically connected with one another by way of an upper connection pipe 30 and a lower connection pipe 32. The lower connection pipe 32 is constructed as a T-pipe piece on whose free connecting piece an exhaust pipe cover 34 is fastened.

Figure 3:
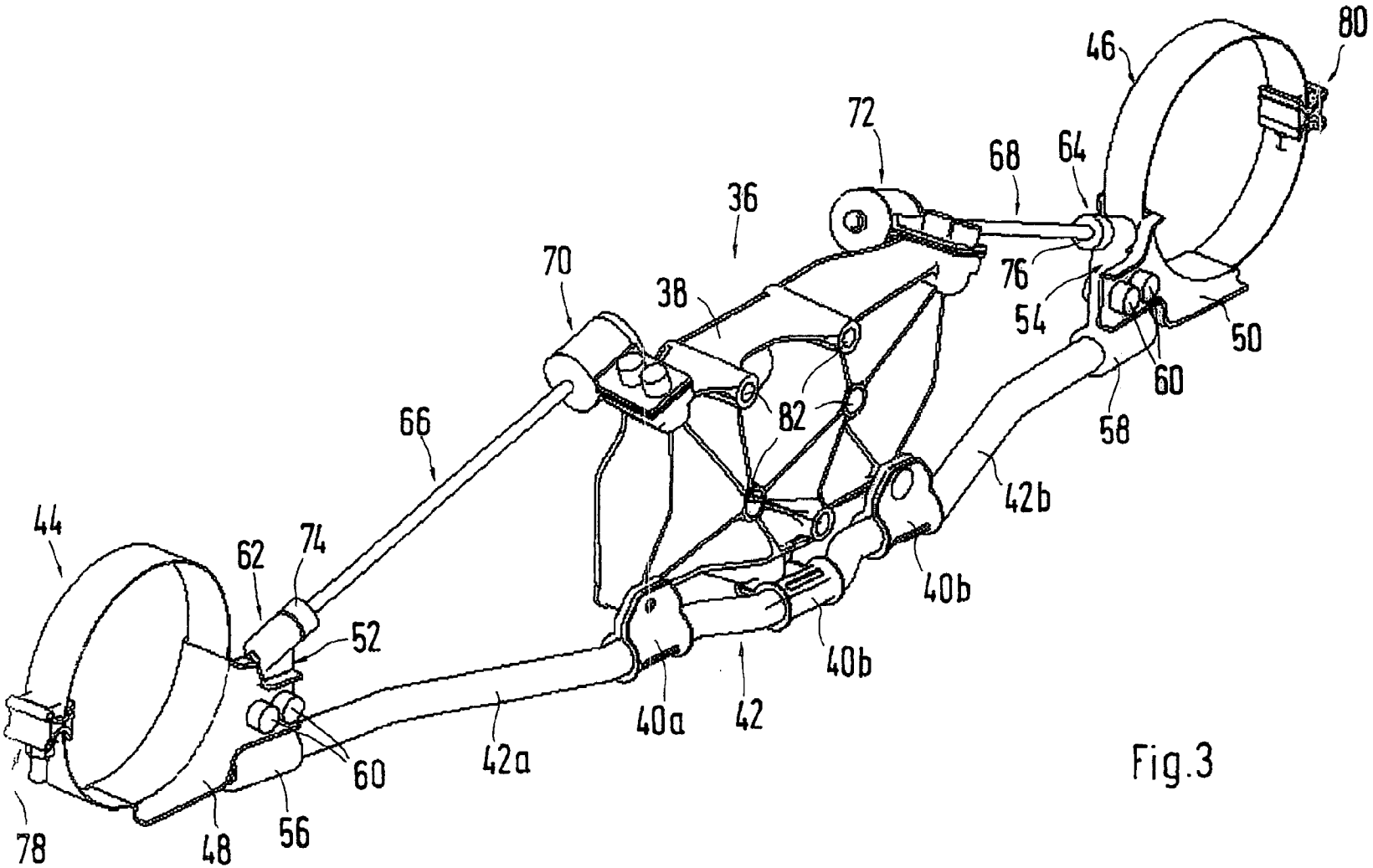
FIG. 3 is a first perspective lateral view of the fastening device.

For the suspension or fastening of the entire exhaust system, a fastening device 36 is provided which has a holding part, also called a carrier plate 38. By way of three pipe clamps 40*a,b,c*, (FIG. 3) a lower pipe stay 42 is fastened to the carrier plate 38, to the left and right supporting leg 42*a*, 42*b* respectively of the pipe stay 42. A fastening clamp 44, 46 respectively reaches around the housing of the starting catalyst 14, 16 respectively. Two saucer-shaped metal holding sheets 48, 50, for the two fastening clamps 44, 46 are screwed to a respective holder 52, 54 which are clampingly fitted on the respective end of the lower pipe stay 42 or the supporting legs 42*a*, 42*b* through a respective bearing bush 56,58 shaped out of the holder 52, 54.

Clamping between the two components is generated by the fastening devices 60 so that the metal holding sheet 48, 50 respectively for the fastening clamps 44, 46 is simultaneously fastened to the respective holder 52, 54.

Furthermore, the two holders 52, 54 each have an upper bearing bush 62, 64 which are each used for receiving an end of an upper tension strut 66, 68 respectively. The other end of the two upper tension struts 66, 68 is screwed by way of a respective damping element 70, 72 to the carrier plate 38. The two damping elements 70, 72 are constructed as bushes in which each upper tension strut 66, 68 is elastically disposed or fastening in rubber elements. In this case, the tensile stress acting upon the two upper tension struts 66, 68 can be adjusted. For this purpose, the end of each upper tension strut 66, 68 received in the respective upper bearing bush 62, 64 has a thread which is screwed into the bearing bush 62, 64. The screwed connection is then secured by a corresponding counter nut 74 and 76. The two clamps 44, 46 fastened to the catalyst housing 22, 24 are in each case secured by a tension clamp 78, 80 respectively.

Figure 4:
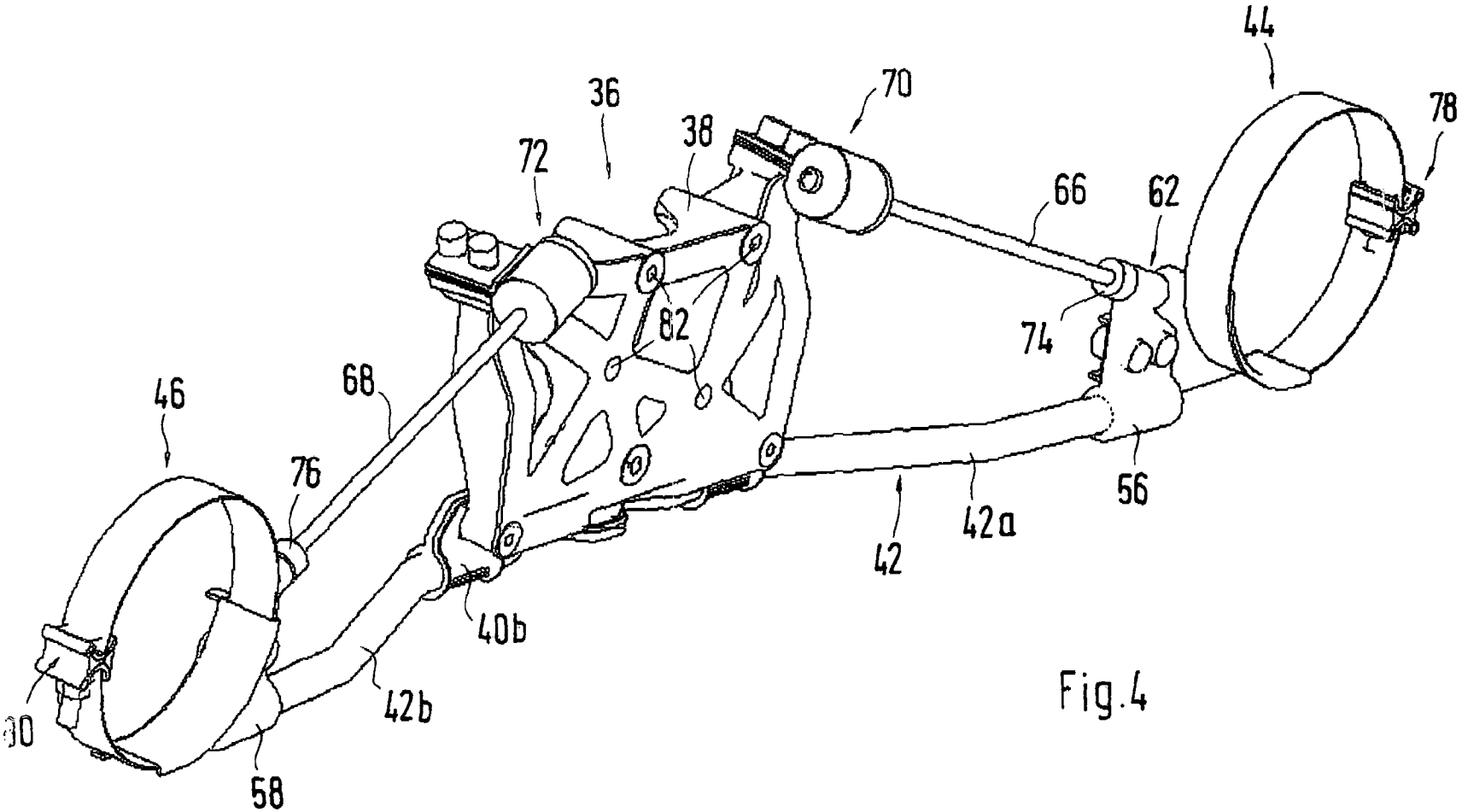
FIG. 4 is a second perspective representation of the fastening device shown in FIG. 3.

The carrier plate 38 constructed as a casting or stamping has fastening openings 82 (FIGS. 3 and 4) which are used for the face-side fastening of the carrier plate 38 on the housing of a transmission not shown. The fastening device 36 for the exhaust system is provided, for example, for the Porsche Boxster model which has a mid-engine arrangement, in which, as viewed in the driving direction, the engine is arranged in front of the transmission. Of course, the described fastening device for the exhaust system can also be fastened on the engine power section, the chassis or the body of the motor vehicle.

The invention claimed is:

1. Exhaust system for a drive unit formed by a transmission and an engine, comprising exhaust-gas-carrying pipes, at least one muffler and catalyst housing, a holding part fastenable to at least one of the transmission and the engine and on a respective supporting leg of which the exhaust system is fastenable or suspendable, and a respective annular fastening clamp configured to reach around a catalyst housing is arranged on each end of the respective supporting leg and to be secured by a clamping arrangement.

2. Exhaust system according to claim 1, wherein the catalyst housing is at least partially integrated in a muffler housing.

3. Exhaust system according to claim 1, wherein each respective supporting leg is configured as a lower continuous strut supported by respective upper struts, each of which operatively connects the holding part and each respective fastening clamps.

4. Exhaust system according to claim 3, wherein each respective supporting leg is configured as a lower continuous strut supported by respective upper struts, each of which operatively connects the holding part and each respective fastening clamp.

5. Exhaust system according to claim 3, wherein a respective damping element is provided at the end of the respective upper strut associated with the holding part.

6. Exhaust system according to claim 3, wherein a respective holder is operatively associated with the respective fastening clamp, the respective holder having the lower strut and the upper struts fastened thereat.

7. Exhaust system according to claim 6, wherein a respective holder is operatively associated with the respective fastening clamp, the respective holder having the lower strut and the upper struts fastened thereat.

8. Exhaust system according to claim 1, wherein the holding part is a one-piece carrier plate configured to be screwable to the transmission of the drive unit by fastening devices.

* * * * *